US009333742B2

(12) United States Patent
Moorlag et al.

(10) Patent No.: US 9,333,742 B2
(45) Date of Patent: May 10, 2016

(54) AQUEOUS INK JET BLANKET

(71) Applicant: Xerox Corporation, Norwalk, CT (US)

(72) Inventors: Carolyn Patricia Moorlag, Mississauga (CA); Yu Qi, Penfield, NY (US); Brynn Mary Dooley, Toronto (CA); Barkev Keoshkerian, Thornhill (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/270,599

(22) Filed: May 6, 2014

(65) Prior Publication Data

US 2015/0321467 A1 Nov. 12, 2015

(51) Int. Cl.
*B41J 2/01* (2006.01)
*B41J 2/005* (2006.01)

(52) U.S. Cl.
CPC ..... *B41J 2/0057* (2013.01); *B41J 2/005* (2013.01); *B41J 2002/012* (2013.01)

(58) Field of Classification Search
None
See application file for complete search history.

(56) References Cited

U.S. PATENT DOCUMENTS

2003/0068571 A1* 4/2003 Uehara ..... B41J 2/0057 430/125.32
2012/0245251 A1* 9/2012 Moorlag ..... C09D 7/1216 523/218

* cited by examiner

*Primary Examiner* — Lisa M Solomon
(74) *Attorney, Agent, or Firm* — Hoffman Warnick LLC

(57) ABSTRACT

There is described a transfer member or blanket for use in aqueous ink jet printer. The transfer member includes a surface layer having a surface roughness (Ra) of from about 50 nm to about 5 microns. The surface layer has a surface energy between 8 mN/m$^2$ and 30 mN/m$^2$. The surface layer includes an elastomeric matrix having a plurality texture particles dispersed therein. The weight percent of the texture particles in the surface layer is from about 0.2 weight percent to about 20 weight percent.

20 Claims, 2 Drawing Sheets

AQUEOUS INK JET BLANKET

BACKGROUND

1. Field of Use

This disclosure is generally directed to inkjet transfix apparatuses and methods. In particular, disclosed herein is a composition that improves the wetting and release capability of an aqueous latex ink in an ink jet printer.

2. Background

Inkjet systems in which a liquid or melt solid ink is discharged through an ink discharge port such as a nozzle, a slit and a porous film are used in many printers due to their characteristics such as small size and low cost. In addition, an inkjet printer can print not only paper substrates, but also on various other substrates such as textiles, rubber and the like.

During the printing process, various intermediate media (e.g., transfer belts, intermediate blankets or drums) may be used to transfer the formed image to the final substrate. In intermediate transfix processes, aqueous latex ink is inkjetted onto a transfer member or intermediate blanket where the ink film is dried with heat or flowing air or both. The dried image is subsequently transfixed on to the final paper substrate. For this process to operate according to desired print performance, the transfer member or blanket has to satisfy two conflicting requirements—the first requirement is that ink has to spread well on the transfer member and the second requirement is that, after drying, the ink should release from the blanket. Since aqueous ink comprises a large amount of water, such ink compositions wet and spread very well on high energy (i.e., greater than 40 $mJ/m^2$) hydrophilic substrates. However, due to the high affinity to such substrates, the aqueous ink does not release well from these substrates. Silicone rubbers with low surface energy (i.e., about 20 $mJ/m^2$ or less) circumvent the release problem. However, a major drawback of the silicone rubbers is that the ink does not wet and spread on these substrates due to low affinity to water. Thus, the ideal transfer member for the transfix process would have both optimum spreading to form good quality image and optimum release properties to transfix the image to paper. While some solutions, such as adding surfactants to the ink to reduce the surface tension of the ink, have been proposed, these solutions present additional problems. For example, the surfactants result in uncontrolled spreading of the ink that causes the edges of single pixel lines to be undesirably wavy. Moreover, aqueous printheads have certain minimum surface tension requirements (i.e., greater than 20 mN/m) that must be met for good jetting performance.

Alternatively, a coating material may be used as a release layer between the transfer member or intermediate blanket and the jetted aqueous ink. Conditions must be met in this instance for the wetting and release of the coating material in relation to the transfer member or intermediate blanket, in order to enable the release of aqueous ink.

Thus, there is a need for a way to provide the desired spreading and release properties for aqueous inks to address the above problems faced in transfix process.

SUMMARY

Disclosed herein is a transfer member for use in aqueous ink jet printer. The transfer member includes a surface layer having a surface roughness (Ra) of from about 50 nm to about 5 microns. The surface layer has a surface energy between 8 $mN/m^2$ and 30 $mN/m^2$. The surface layer includes an elastomeric matrix having a plurality texture particles dispersed therein. The weight percent of the texture particles in the surface layer is from about 0.2 weight percent to about 20 weight percent.

There is provided a transfer member for use in aqueous ink jet printer. The transfer member includes a surface layer having a surface roughness (Ra) of from about 500 nm to about 1 microns. The surface layer includes an elastomeric matrix having a plurality texture particles dispersed therein. The plurality of texture particles has a surface energy lower than a surface energy of the elastomeric matrix. The weight percent of the texture particles in the surface layer is from about 0.2 weight percent to about 20 weight percent.

Disclosed herein is an ink jet printer that includes a transfer member. The transfer member includes a surface layer having a surface roughness of from about 500 nm to about 1 microns. The surface layer includes an elastomeric matrix having a plurality texture particles dispersed therein. The plurality of texture particles has either a density lower than a density of the elastomeric matrix or a surface energy lower than a surface energy of the elastomeric matrix. The plurality of texture particles in the surface layer is from about 3 weight percent to about 8 weight percent of the transfer member. The ink jet printer includes a print head adjacent to the transfer member for ejecting aqueous ink droplets onto the surface layer of the transfer member to form an ink image. The ink jet printer includes a transfixing station located adjacent the transfer member and downstream from the print head. The transfixing station forms a transfixing nip with the transfer member at the transfixing station. The ink jet printer includes a transporting device for delivering a recording medium to the transfixing nip. The ink image is transferred and fixed to the recording medium.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
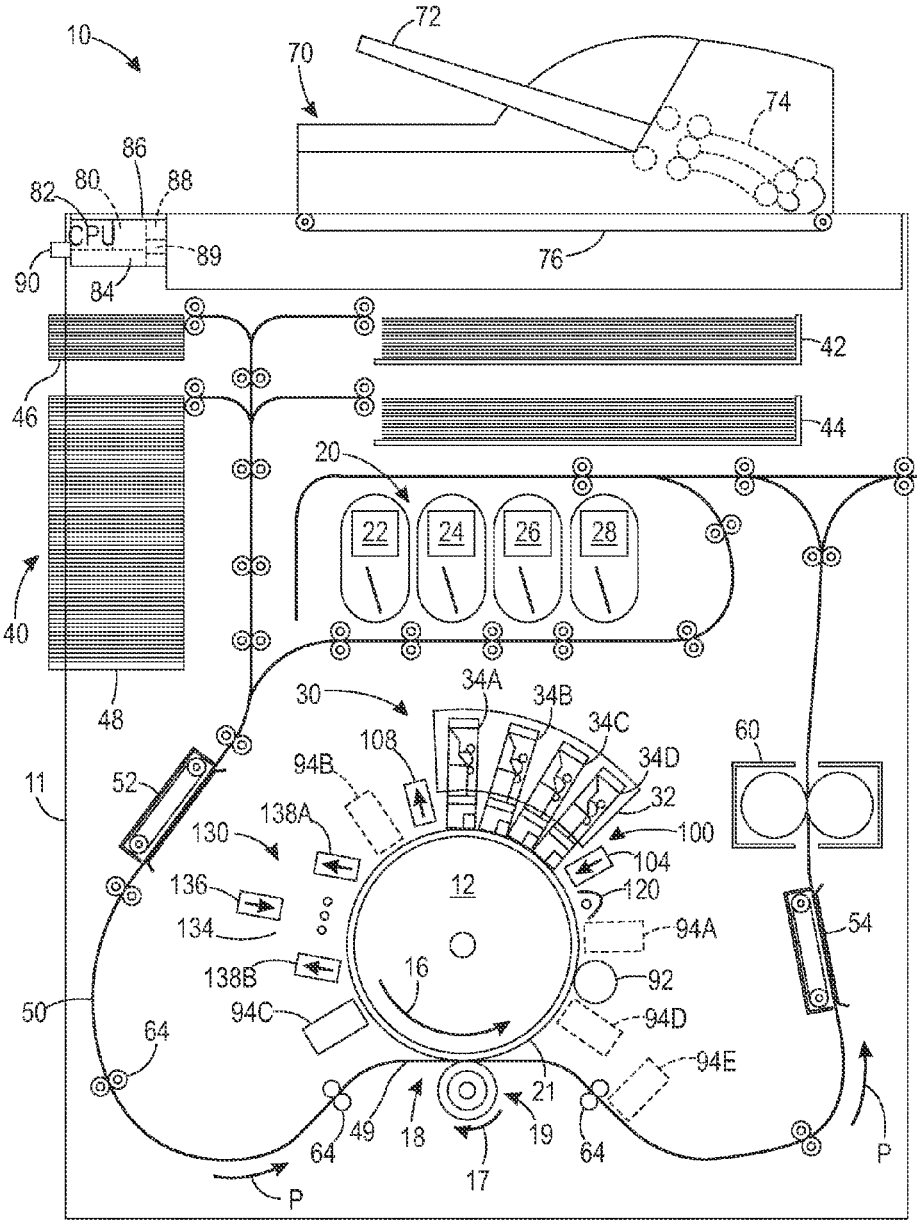
FIG. 1 is a schematic diagram illustrating an aqueous ink image printer.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

In a direct printer, the printheads eject ink drops directly onto a print medium, for example a paper sheet or a continuous media web. After ink drops are printed on the print medium, the printer moves the print medium through a nip formed between two rollers that apply pressure and, optionally, heat to the ink drops and print medium. One roller, typically referred to as a "spreader roller" contacts the printed side of the print medium. The second roller, typically referred to as a "pressure roller," presses the media against the spreader roller to spread the ink drops and fix the ink to the print medium.

FIG. 1 illustrates a high-speed aqueous ink image producing machine or printer 10. As illustrated, the printer 10 is an indirect printer that forms an ink image on a surface of a transfer member 12, (also referred to as a blanket or receiving member or image member) and then transfers the ink image to media passing through a nip 18 formed with the transfer member 12. The printer 10 includes a frame 11 that supports directly or indirectly operating subsystems and components, which are described below. The printer 10 includes the transfer member 12 that is shown in the form of a drum, but can also be configured as a supported endless belt. The transfer member 12 has an outer surface 21. The outer surface 21 is movable in a direction 16, and on which ink images are formed. A transfix roller 19 rotatable in the direction 17 is loaded against the surface 21 of transfer member 12 to form a transfix nip 18, within which ink images formed on the surface 21 are transfixed onto a media sheet 49.

The transfer member 12 or blanket is formed of a material having a relatively low surface energy to facilitate transfer of the ink image from the surface 21 of the transfer member 12 to the media sheet 49 in the nip 18. Such materials are described in more detail below. A surface maintenance unit (SMU) 92 removes residual ink left on the surface of the blanket 21 after the ink images are transferred to the media sheet 49.

The SMU 92 can optionally include a coating applicator having a reservoir with a fixed volume of coating material and a donor roller, which can be smooth or porous and is rotatably mounted in the reservoir for contact with the coating material. The donor roller can be an elastomeric roller or alternatively an anilox roller with a surface coating material of stainless steel or ceramic. The coating material is applied to the surface of the blanket 21 to form a thin layer on the blanket surface. The SMU 92 is operatively connected to a controller 80, described in more detail below, to enable the controller to operate the donor roller, metering blade and cleaning blade selectively to deposit and distribute the coating material onto the surface of the blanket and remove un-transferred ink pixels from the surface 21 of the blanket or transfer member 12.

Continuing with the general description, the printer 10 includes an optical sensor 94A, also known as an image-on-drum ("IOD") sensor, that is configured to detect light reflected from the surface 21 of the transfer member 12 and the coating applied to the surface 21 as the member 12 rotates past the sensor. The optical sensor 94A includes a linear array of individual optical detectors that are arranged in the cross-process direction across the surface 21 of the transfer member 12. The optical sensor 94A generates digital image data corresponding to light that is reflected from the surface 21. The optical sensor 94A generates a series of rows of image data, which are referred to as "scanlines," as the transfer member 12 rotates in the direction 16 past the optical sensor 94A. In one embodiment, each optical detector in the optical sensor 94A further comprises three sensing elements that are sensitive to frequencies of light corresponding to red, green, and blue (RGB) reflected light colors. The optical sensor 94A also includes illumination sources that shine red, green, and blue light onto the surface 21. The optical sensor 94A shines complementary colors of light onto the image receiving surface to enable detection of different ink colors using the RGB elements in each of the photodetectors. The image data generated by the optical sensor 94A is analyzed by the controller 80 or other processor in the printer 10 to identify the thickness of ink image and wetting enhancement coating (explained in more detail below) on the surface 21 and the area coverage. The thickness and coverage can be identified from either specular or diffuse light reflection from the blanket surface and coating. Other optical sensors, such as 94B, 94C, and 94D, are similarly configured and can be located in different locations around the surface 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 also can include a surface energy applicator 120 positioned next to the surface 21 of the transfer member 12 at a position immediately prior to the surface 21 entering the print zone formed by printhead modules 34A-34D. The surface energy applicator 120 can be, for example, corona discharge unit, an oxygen plasma unit or an electron beam unit. The surface energy applicator 120 is configured to emit an electric field between the applicator 120 and the surface 21 that is sufficient to ionize the air between the two structures and apply negatively charged particles, positively charged particles, or a combination of positively and negatively charged particles to the surface 21 or the transfer member. The electric field and charged particles increase the surface energy of the blanket surface and are described in more detail below. The increased surface energy of the surface 21 of transfer member 12 enables the ink drops subsequently ejected by the printheads in the modules 34A-44D to adhere to the surface 21 or transfer member 12 and coalesce.

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the intermediate transfer member 12 and ejects ink drops onto the surface 21. A printhead module can include a single printhead or a plurality of printheads configured in a staggered arrangement. Each printhead module is operatively connected to a frame (not shown) and aligned to eject the ink drops to form an ink image on the surface 21. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the surface 21 exits the print zone, the image passes under an image dryer 130. The image dryer 130 includes an infrared heater 134, a heated air source 136, and air returns 138A and 138B. The infrared heater 134 applies infrared heat to the printed image on the surface 21 of the transfer member 12 to evaporate water or solvent in the ink. The heated air source 136 directs heated air over the ink to supplement the evaporation of the water or solvent from the ink. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In one embodiment, the fusing device 60 adjusts a gloss level of the printed images that are formed on the print medium. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the surface 21 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the surface 21 of the transfer member 12 to the media substrate within the transfix nip 18.

In some printing operations, a single ink image can cover the entire surface 21 (single pitch) or a plurality of ink images can be deposited on the surface 21 (multi-pitch). In a multi-pitch printing architecture, the surface 21 of the transfer member 12 (also referred to as image receiving member) can be partitioned into multiple segments, each segment including a full page image in a document zone (i.e., a single pitch) and inter-document zones that separate multiple pitches formed on the surface 21. For example, a two pitch image receiving member includes two document zones that are separated by two inter-document zones around the circumference of the surface 21. Likewise, for example, a four pitch image receiving member includes four document zones, each corresponding to an ink image formed on a single media sheet, during a pass or revolution of the surface 21.

Once an image or images have been formed on the surface under control of the controller 80, the illustrated inkjet printer 10 operates components within the printer to perform a process for transferring and fixing the image or images from the surface 21 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the surface 21 of transfer member 12. The transfix roller 19 applies pressure against the back side of the recording media 49 in order to press the front side of the recording media 49 against the surface 21 of the transfer member 12. Although the transfix roller 19 can also be heated, in the embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the transfer member 12 onto the media sheet 49.

The rotation or rolling of both the transfer member 12 and transfix roller 19 not only transfixes the images onto the media sheet 49, but also assists in transporting the media sheet 49 through the nip. The transfer member 12 continues to rotate to continue the transfix process for the images previously applied to the coating and blanket 21.

As shown and described above the transfer member 12 or image receiving member initially receives the ink jet image. After ink drying, the transfer member 12 releases the image to the final print substrate during a transfer step in the nip 18. The transfer step is improved when the surface 21 of the transfer member 12 has a relatively low surface energy. However, a surface 21 with low surface energy works against the desired initial ink wetting (spreading) on the transfer member 12. Unfortunately, there are two conflicting requirements of the surface 21 of transfer member 12. The first aims for the surface to have high surface energy causing the ink to spread and wet (i.e. not bead-up). The second requirement is that the ink image once dried has minimal attraction to the surface 21 of transfer member 12 so as to achieve maximum transfer efficiency (target is 100%), this is best achieved by minimizing the surface 21 surface energy.

In transfix processes, as shown in FIG. 1, an aqueous ink at room temperature (i.e., 20-27° C.) is jetted by onto the surface of transfer member 12, also referred to as a blanket. After jetting, the transfer member 12 moves to a heater zone 136 where the ink is dried and then the dried image is transfixed onto recording medium 49 in transfix nip 19. The transfer member 12 is also referred to as intermediate media, blanket, intermediate transfer member and imaging member.

The transfer member 12 can be of any suitable configuration. Examples of suitable configurations include a sheet, a film, a web, a foil, a strip, a coil, a cylinder, a drum, an endless strip, a circular disc, a drelt (a cross between a drum and a belt), a belt including an endless belt, an endless seamed flexible belt, and an endless seamed flexible imaging belt. The transfer member 12 can be a single layer or multiple layers.

Incorporating texture into the surface of the transfer member enables wetting of the hydrophobic surface. It is desirable to avoid complicated processing methods such as lithographic templating or casting.

Disclosed herein is a transfer member for use in aqueous ink jet printer. The transfer member has a texture creating a surface roughness. The texture of the surface is obtained by dispersing or incorporating a plurality of texture particles in the elastomeric matrix of the transfer member.

Figure 2:
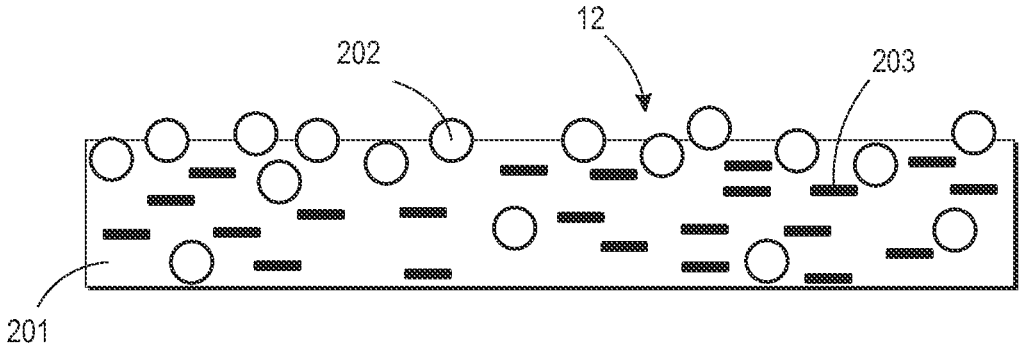
FIG. 2 is a cross-sectional view of a transfer member disclosed herein.

Shown in FIG. 2 is a cross-sectional view of the transfer member 12. The transfer member 12 includes a polymer matrix 201 of low surface energy polymer. The transfer member 12 includes texture particles 202 to create the textured surface. The textured surface has an Ra roughness in the range of from about 50 nm to 5 microns, or from about 100 nm to 2 micron, or from about 0.5 microns to 1 micron, with the surface energy of the surface of the transfer member 12 between 8 $mN/m^2$ and 30 $mN/m^2$, or between 10 $mN/m^2$ and 25 $mN/m^2$, or between 12 $mN/m^2$ and 20 $mN/m^2$, which enables wetting of a suitable aqueous ink composition, while maintaining release through the use of a low surface tension base polymer matrix. Optional additives 203 can be dispersed within the polymeric matrix 201.

The textured surface is enabled by the use of texture particles with one or all of the following characteristics. The texture particles 202 have a lower density than the polymer matrix 201. The texture particles 202 have a lower surface tension than the polymer matrix 201. The texture particles 202 have a propensity for non-agglomeration within the polymer matrix 201, but may have a propensity for agglomeration at the surface of the polymer matrix 201, to form surface features. Some or all of these factors contribute to the preference for texture particles to reside at the coating surface, with the optional clustering of particle, with the result in all cases of the formation of surface roughness.

Examples of materials used for as the elastomeric matrix in transfer member 12 include silicones, fluorosilicones, fluoroplastics, fluoroelastomers copolymers of two of vinylidenefluoride, hexafluoropropylene, terpolymers of vinylidenefluoride, hexafluoropropylene, and tetrafluoroethylene, and tetrapolymers of vinylidenefluoride, hexafluoropropylene, perfluoromethylvinylether (PMVE). Fluorosilicones and silicones include room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning.

Fluoroelastomers or fluoro rubber of the polymethylene type use vinylidene fluoride as a co-monomer and has substituent fluoro, alkyl, perfluoroalkyl, or perfuoroalkoxy groups on the polymer chain. Fluoroelastomers are categorized under the ASTM D1418, and have the ISO 1629 designation FKM. Examples of known fluoroelastomers are (1) a class of copolymers of two of vinylidenefluoride, hexafluoropropylene, such as those known commercially as VITON A®; (2) a class of terpolymers of vinylidenefluoride, hexafluoropropylene, and tetrafluoroethylene known commercially as VITON B®; and (3) a class of tetrapolymers of vinylidenefluoride, hexafluoropropylene, perfluoromethylvinylether (PMVE) known commercially as VITON GH® or VITON GF®.

The polymer matrix 201 has a surface tension of from about 18 mN/m and 35 mN/m, or between 18 mN/m and 30 mN/m, or between 18 mN/m and 25 mN/m. The density of the polymer matrix is from about 0.7 g/cc to about 2.8 g/cc, or from about 0.8 g/cc to about 2.0 g/cc, or from about 0.9 g/cc to about 1.3 g/cc.

The texture particles 202 used to create texture in the surface include low density fillers aerogel particles (silica aerogel, carbon aerogel and metal oxide aerogels), surface treated aerogel particles (trimethylsilyl-treated silica aerogel) with low surface tension, fluorinated polyhedral oligomeric silsesquioxane (POSS), fluorinated silica particles, fluoroplastic particles and fluorocarbon particles.

The fluorinated polyhedral oligomeric silsesquioxane is represented by:

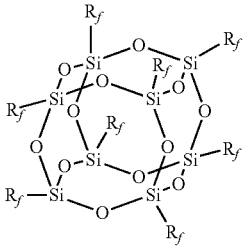

wherein $R_f$ is a linear aliphatic or aromatic fluorocarbon chain having from 2 to 40 carbon atoms. In embodiments Rf is $CH_2CH_2CF_2CF_2CF_2CF_3$ (fluorohexyl) or $CH_2CH_2CF_2CF_2CF_2CF_2CF_2CF_3$ (fluorooctyl) or $CH_2CH_2CF_2CF_2CF_2CF_2CF_2CF_2CF_2CF_3$ (fluorodecyl).

Aerogels may be described, in general terms, as gels that have been dried to a solid phase by removing pore fluid and replacing the pore fluid with air. As used herein, an "aerogel" refers to a material that is generally a very low density ceramic solid, typically formed from a gel. The term "aerogel" is thus used to indicate gels that have been dried so that the gel shrinks little during drying, preserving its porosity and related characteristics. In contrast, "hydrogel" is used to describe wet gels in which pore fluids are aqueous fluids. The term "pore fluid" describes fluid contained within pore structures during formation of the pore element(s). Upon drying, such as by supercritical drying, aerogel particles are formed that contain a significant amount of air, resulting in a low density solid and a high surface area. In various embodiments, aerogels are thus low-density microcellular materials characterized by low mass densities, large specific surface areas and very high porosities. In particular, aerogels are characterized by their unique structures that comprise a large number of small inter-connected pores. After the solvent is removed, the polymerized material is pyrolyzed in an inert atmosphere to form the aerogel.

Any suitable aerogel component can be used. In embodiments, the aerogel component can be, for example, selected from inorganic aerogels, organic aerogels, carbon aerogels, and mixtures thereof. In particular embodiments, ceramic aerogels can be suitably used. These aerogels are typically composed of silica, but may also be composed of metal oxides, such as alumina, titania and zirconia, or carbon, and can optionally be doped with other elements such as a metal. In some embodiments, the aerogel component can comprise aerogels chosen from polymeric aerogels, colloidal aerogels, and mixtures thereof.

Aerogel particles of embodiments may have porosities of from about 50 percent to about 99.9 percent, in which the aerogel can contain 99.9 percent empty space. In embodiments the aerogel particles have porosities of from about 50 percent to about 99.0 percent, or from 50 percent to about 98 percent. In embodiments, the pores of aerogel components may have diameters of from about 2 nm to about 500 nm, or from about 10 nm to about 400 nm or from about 20 nm to about 100 nm. In particular embodiments, aerogel components may have porosities of more than 50% pores with diameters of less than 100 nm and even less than about 20 nm. In embodiments, the aerogel components may be in the form of particles having a shape that is spherical, or near-spherical, cylindrical, rod-like, bead-like, cubic, platelet-like, and the like.

Further, aerogel particles in embodiments may have surface areas ranging from about 400 $m^2/g$ to about 1200 $m^2/g$, such as from about 500 $m^2/g$ to about 1200 $m^2/g$, or from about 700 $m^2/g$ to about 900 $m^2/g$. In embodiments, aerogel components may have electrical resistivities greater than about $1.0\times10^{-4}$ Ω-cm, such as in a range of from about 0.01 Ω-cm to about $1.0\times10^{16}$ Ω-cm, from about 1 Ω-cm to about $1.0\times10^{8}$ Ω-cm, or from about 50 Ω-cm to about 750,000 Ω-cm. Different types of aerogels used in various embodiments may also have electrical resistivities that span from conductive, about 0.01 to about 1.00 Ω-cm, to insulating, more than about $10^{16}$ Ω-cm. Conductive aerogels of embodiments, such as carbon aerogels, may be combined with other conductive fillers to produce combinations of physical, mechanical, and electrical properties that are otherwise difficult to obtain.

Aerogels that can suitably be used in embodiments may be divided into three major categories: inorganic aerogels, organic aerogels and carbon aerogels. In embodiments, the transfer member layer may contain one or more aerogels chosen from inorganic aerogels, organic aerogels, carbon aerogels and mixtures thereof. For example, embodiments can include multiple aerogels of the same type, such as combinations of two or more inorganic aerogels, combinations of two or more organic aerogels, or combinations of two or more carbon aerogels, or can include multiple aerogels of different types, such as one or more inorganic aerogels, one or more organic aerogels, and/or one or more carbon aerogels. For example, a chemically modified, hydrophobic silica aerogel may be combined with a high electrical conductivity carbon aerogel to simultaneously modify the hydrophobic and electrical properties of a composite and achieve a desired target level of each property.

Inorganic aerogels, such as silica aerogels, are generally formed by sol-gel polycondensation of metal oxides to form highly cross-linked, transparent hydrogels. These hydrogels are subjected to supercritical drying to form inorganic aerogels.

In embodiments, carbon aerogels may be combined with, coated, or doped with a metal to improve conductivity, magnetic susceptibility, and/or dispersibility. Metal-doped carbon aerogels may be used in embodiments alone or in blends with other carbon aerogels and/or inorganic or organic aerogels. Any suitable metal, or mixture of metals, metal oxides and alloys may be included in embodiments in which metal-doped carbon aerogels are used. In particular embodiments, and in specific embodiments, the carbon aerogels may doped with one or more metals chosen from transition metals (as defined by the Periodic Table of the Elements) and aluminum, zinc, gallium, germanium, cadmium, indium, tin, mercury, thallium and lead. In particular embodiments, carbon aerogels are doped with copper, nickel, tin, lead, silver, gold, zinc, iron, chromium, manganese, tungsten, aluminum, platinum, palladium, and/or ruthenium. For example, in embodiments, copper-doped carbon aerogels, ruthenium-doped carbon aerogels and mixtures thereof may be included in the composite.

The aerogel particles can include surface functionalities selected from the group of alkylsilane, alkylchlorosilane, alkylsiloxane, polydimethylsiloxane, aminosilane and methacrylsilane. In embodiments, the surface treatment material that contains functionality reactive to aerogel that will result in modified surface interactions.

Surface texture may be formed on the transfer member surface if the texture particles 202 have a density lower than a density of the elastomeric matrix. The density of the texture particles is from about 0.2 micrograms/cc to about 1 g/cc or in embodiments from about from about 0.5 micrograms/cc to about 0.8 g/cc, or from about 1.0 micrograms/cc to about 0.5 g/cc. The density ratio of the texture particles compared to the density of the polymer matrix is an amount less than 0.8, or an amount less than 0.5, or an amount less than 0.2.

Surface texture may be formed on the transfer member surface if the texture particles 202 used to create texture in the surface particles have a surface energy lower than surface energy of the polymer matrix. The texture particles have a surface energy of from about 8 mN/m to about 25 mN/m, or from about 10 mN/m to about 20 mN/m, or from about 12 mN/m to about 18 mN/m. The difference between the surface energy of the texture particles compared to the surface energy of the polymer matrix is an amount between about 2 mN/m to about 20 mN/m, or between about 5 mN/m to about 18 mN/m, or between about 10 mN/m to about 15 mN/m. Surface tension of the exterior of the texture particles is measured by powder wettability measurement. This can be achieved using specialized tensiometers, or liquid contact angles on ground, compacted powders.

In embodiments, the non-clustering texture particles are of an average particle size of from about 1 nm to about 2 μm, or about 50 nm to about 1 μm, or about 100 μm to 0.8 μm. In other embodiments, the texture particles may be agglomerations, or clusters, of fine particles.

The loading of the texture particles to create texture on the surface of the transfer member is from about is 0.2 percent to about 20 percent by weight of the transfer member. In embodiments the loading of the filler particles to create texture is from about 1 percent by weight to about 10 percent by weight, or from about 3 percent by weight to about 8 percent by weight.

Optional fillers 203 include inorganic oxides (silica, alumina, iron oxide) or carbon particles (carbon black, graphite, carbon nanotubes). Optional fillers can effectively function to modify the effective internal surface tension of the matrix polymer 201 in a mobile liquid phase and thus change the compatibility between the matrix polymer and the texture particle. By increasing the difference between 1) the effective internal surface tension of the matrix polymer and the optional fillers together, and 2) the surface energy of the texture particles, formation of surface texture is enabled or is enhanced. A resulting texture is formed at the surface of the transfer member 12. Additives with surface functionalizing groups may be capable of bonding directly into the polymer matrix. The loading of the optional fillers is in the range of about 0.5 to about 10 weight percent, or about 1 to about 5 weight percent, or about 2 to about 3 weight percent.

In embodiments, the transfer member 12 can have a thickness of from about 20 micron to about 5 mm, or from about 100 microns to about 4 mm, or from about 500 microns to about 3 mm. The transfer member may be a multi-layered member with a functional topcoat comprising the compositions described.

The disclosed transfer member 12 has texture particles 202 reside at the surface 21 of the transfer member 12. This is achieved through texture particles that are lower in surface energy than the polymer matrix, or through texture particles that are lower density than the polymer matrix, or both. Clustering of texture particles at the transfer member surface can enable texture at the surface in the instance of particles that are less than 50 nm, or less that 10 nm, or less than 2 nm. Clustering of texture forming particles can enhance texture at the surface.

An ink suitable for the aqueous ink jet print process must have surface tension, viscosity, and particle size suitable for use in a piezoelectric inkjet printhead. These values for jet-table inks are typically in the range of 3-20 cps (viscosity), 20-40 mN/m (surface tension) and <600 nm (particle size). Additionally, the ink must wet the intermediate receiving member to enable formation of the transient image as well as undergo a stimulus induced property change in order to enable release from the intermediate receiving member in the transfer step.

The ink compositions that can be used with the present embodiments are aqueous-dispersed polymer or latex inks Such inks are desirable to use since they are water-based inks that are said to have almost the same level of durability as solvent inks. In general, these inks comprise one or more polymers dispersed in water. The inks disclosed herein also contain a colorant. The colorant can be a dye, a pigment, or a mixture thereof. Examples of suitable dyes include anionic dyes, cationic dyes, nonionic dyes, zwitterionic dyes, and the like. Specific examples of suitable dyes include food dyes such as Food Black No. 1, Food Black No. 2, Food Red No. 40, Food Blue No. 1, Food Yellow No. 7, and the like, FD & C dyes, Acid Black dyes (No. 1, 7, 9, 24, 26, 48, 52, 58, 60, 61, 63, 92, 107, 109, 118, 119, 131, 140, 155, 156, 172, 194, and the like), Acid Red dyes (No. 1, 8, 32, 35, 37, 52, 57, 92, 115, 119, 154, 249, 254, 256, and the like), Acid Blue dyes (No. 1, 7, 9, 25, 40, 45, 62, 78, 80, 92, 102, 104, 113, 117, 127, 158, 175, 183, 193, 209, and the like), Acid Yellow dyes (No. 3, 7, 17, 19, 23, 25, 29, 38, 42, 49, 59, 61, 72, 73, 114, 128, 151, and the like), Direct Black dyes (No. 4, 14, 17, 22, 27, 38, 51, 112, 117, 154, 168, and the like), Direct Blue dyes (No. 1, 6, 8, 14, 15, 25, 71, 76, 78, 80, 86, 90, 106, 108, 123, 163, 165, 199, 226, and the like), Direct Red dyes (No. 1, 2, 16, 23, 24, 28, 39, 62, 72, 236, and the like), Direct Yellow dyes (No. 4, 11, 12, 27, 28, 33, 34, 39, 50, 58, 86, 100, 106, 107, 118, 127, 132, 142, 157, and the like), Reactive Dyes, such as Reactive Red Dyes (No. 4, 31, 56, 180, and the like), Reactive Black dyes (No. 31 and the like), Reactive Yellow dyes (No. 37 and the like); anthraquinone dyes, monoazo dyes, disazo dyes, phthalocyanine derivatives, including various phthalocyanine sulfonate salts, aza(18)annulenes, formazan copper complexes, triphenodioxazines, and the like; and the like, as well as mixtures thereof. The dye is present in the ink composition in any desired or effective amount, in one embodiment from about 0.05 to about 15 percent by weight of the ink, in another embodiment from about 0.1 to about 10 percent by weight of the ink, and in yet another embodiment from about 1 to about 5 percent by weight of the ink, although the amount can be outside of these ranges.

Examples of suitable pigments include black pigments, white pigments, cyan pigments, magenta pigments, yellow pigments, or the like. Further, pigments can be organic or inorganic particles. Suitable inorganic pigments include, for example, carbon black. However, other inorganic pigments may be suitable, such as titanium oxide, cobalt blue ($CoO-Al_2O_3$), chrome yellow ($PbCrO_4$), and iron oxide. Suitable organic pigments include, for example, azo pigments including diazo pigments and monoazo pigments, polycyclic pigments (e.g., phthalocyanine pigments such as phthalocyanine blues and phthalocyanine greens), perylene pigments, perinone pigments, anthraquinone pigments, quinacridone pigments, dioxazine pigments, thioindigo pigments, isoindolinone pigments, pyranthrone pigments, and quinophthalone pigments), insoluble dye chelates (e.g., basic dye type chelates and acidic dye type chelate), nitropigments, nitroso pigments, anthanthrone pigments such as PR168, and the like. Representative examples of phthalocyanine blues and greens include copper phthalocyanine blue, copper phthalocyanine green, and derivatives thereof (Pigment Blue 15, Pigment Green 7, and Pigment Green 36).

The inks described herein are further illustrated in the following examples. All parts and percentages are by weight unless otherwise indicated.

Specific embodiments will now be described in detail. These examples are intended to be illustrative, and not limited to the materials, conditions, or process parameters set forth in these embodiments. All parts are percentages by solid weight unless otherwise indicated.

EXAMPLES

Example 1

Various substrates were used beneath the transfer member topcoat layer, including silicone or polyimide. Surface texture was obtained by the incorporation of POSS particles into Viton, with and without the incorporation of carbon nanotubes as optional additives. Fluorinated POSS molecules were prepared by the acid-catalyzed hydrolysis of commercially available (3,3,3-trifluoropropyl)trichlorosilane, followed by condensation to form silsesquioxane cages, as shown below. The molecular structure was confirmed by 1H, 13C, 19F, and 29Si NMR spectroscopy in deuterated acetone.

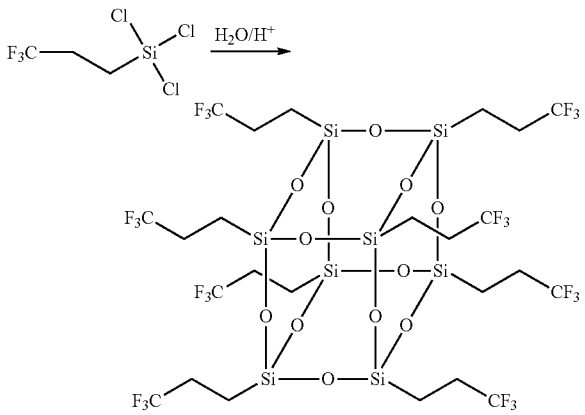

Coatings were formed with various concentrations of fluorinated POSS particles (e.g., 5% and 20% by weight of VITON® GF) with 7 pph VC-50 cross-linker, MgO of 0.75 pph, and surfactant in MIBK solvent.

VITON® transfer member topcoats were prepared by pouring mixtures of the coating compositions dispersed in MIBK into molds, allowing the compositions to dry, and curing the compositions at temperatures of up to 232° C.

The CNT-containing coating compositions and resulting transfer member topcoats included 3 weight percent CNTs having and fluorinated POSS (texture particles) of about 5 and 20 weight percent based on the weight of VITON® GF.

Four VITON® composite material samples were prepared according to the examples above to have 5 weight percent POSS; 20 weight percent POSS; 5 weight percent POSS plus 3 weight percent CNT; or 20 weight percent POSS plus 3 weight percent CNT, respectively.

The VITON® composite material/outermost layer having 5 weight percent POSS with no CNTs displayed roughness without the formation of regular surface features. The composite material containing 20 weight percent of the fluorinated POSS by weight of VITON® displayed a surface with moderately spherical features ranging from about 5 microns to about 50 microns. The composite material of 2-5 weight percent POSS incorporated with 3 weight percent CNTs displayed enhancement of the surface effect via the formation of features at the surface that were less than 5 microns. The presence of CNT increases the uniformity, and in some cases the size, of the dominant surface features.

The surface features that form on the various transfer member surfaces contain a high concentration of fluorinated POSS, as can be verified by energy dispersive spectroscopy (EDS) to determine silicon (Si) content.

The surface energy values for the prepared composite materials are as follows: 5 weight percent POSS and 20 weight percent POSS are about equivalent to Viton at 23 $mN/m^2$, 5 weight percent POSS incorporated with 3 weight percent CNTs is about 18 $mN/m^2$, and 20 weight percent POSS incorporated with 3 weight percent CNTs is about 20 $mN/m^2$.

Example 2

Surface texture in the range of 1-5 microns is demonstrated by the incorporation of silica aerogel into fluoropolymers such as Viton. The silica aerogel is approximately 1 micron particle size, and incorporated in an amount between 3 and 5 weight percent compared to the weight of Viton.

A transfer member topcoat layer is formed by applying a polymer solution including approximately 10-30 percent total solids weight basis in a pre-metered coating flow, dispensed between a blade and rotating fuser roll surface (rpm range between 40-200). The blade provides flow leveling around the roll circumference of the fuser substrate. The dispensing head and metering blade traverses along the length of the roll having a speed of about 2-20 mm/s so that the entire roll surface is coated in a spiral pattern. Successful flow coating conducted in this manner depends on coating rheology, blade angle, tip pressure, traverse speed, dispense rate and/or other factors as known to one of ordinary skill in the field of liquid film coating.

The solvent evaporated from the coated roll leaves a dry film including polymer, aerogel ceramic particles, and/or other additives. After drying, the processed member is placed in a Grieve oven to thermally cure the formed topcoat over the roll substrate. Standard VITON curing conditions are used.

The roughness of the aerogel/Viton transfer member is about 1-2 microns. The surface energy of the silica aerogel/Viton topcoat is about 20 $mN/m^2$ to about 23 $mN/m^2$.

Example 3

Surface texture is obtained by the incorporation of carbon aerogel into silicone. Dow Toray SE9187 black silicone (Dow Corning Company) is diluted 2:1 with solvent (such as, toluene, heptane, ethanol) to a viscosity less than 300 cps as is suitable for casting. To the diluted silicone is mixed in 3 percent by weight of carbon aerogel of an average particle size of 0.5 microns. Other fluorocarbon elastomers, fluorosilicone rubber, and one- or two-component silicone systems, and certain other non-silicone-based systems may be used in place of Toray black silicone, with varying ratios of solvent dilution.

Upon drying, the textured imaging blanket surface with uniform peak-to-valley height has an Ra of about between 0.5 microns and 1.5 microns. Compositional texture may be further enhanced by a surface subtractive process such as a chemical etch, plasma etching, or physical abrasion. The surface energy of the carbon aerogel/silicone topcoat is about 18 $mN/m^2$ to about 20 $mN/m^2$.

Example 4

Surface texture is obtained by the incorporation of silica aerogel into fluorosilicone. Dow Toray SE9187 black silicone (Dow Corning Company) is diluted 2:1 with solvent (such as, toluene, heptane, ethanol) to a viscosity less than 300 cps as is suitable for casting. To the diluted silicone is mixed in 3% by weight of silica aerogel of an average particle size of 1 micron. Other fluorocarbon elastomers, fluorosilicone rubber, and one- or two-component silicone systems, and certain other non-silicone-based systems may be used in place of Toray black silicone, with varying ratios of solvent dilution.

Upon drying, the textured imaging blanket surface with uniform peak-to-valley height is expected to have an Ra of about between 1 microns and 2 microns. Compositional texture may be further enhanced by a surface subtractive process such as a chemical etch, plasma etching, or physical abrasion. The surface energy of the carbon aerogel/silicone topcoat is about 16 $mN/m^2$ to about 18 $mN/m^2$.

Surface texture in the range of 1-5 microns has been demonstrated by the incorporation of silica aerogel into fluoropolymers such as PTFE and Viton.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A transfer member for use in aqueous ink jet printer, the transfer member comprising: a surface layer having a surface roughness (Ra) of from about 50 nm to about 5 microns, the surface layer having a surface energy between 8 $mN/m^2$ and 30 $mN/m^2$, the surface layer including an elastomeric matrix having a plurality texture particles dispersed therein, wherein a weight percent of the texture particles in the surface layer is from about 0.2 weight percent to about 20 weight percent.

2. The transfer member of claim 1, wherein the elastomeric matrix is selected from the group consisting of silicones, fluorosilicones, fluoroplastics, fluoroelastomers, copolymers of two of vinylidenefluoride, hexafluoropropylene, terpolymers of vinylidenefluoride, hexafluoropropylene, and tetrafluoroethylene, and tetrapolymers of vinylidenefluoride, hexafluoropropylene, perfluoromethylvinylether (PMVE).

3. The transfer member of claim 1, wherein the texture particles are selected from the group consisting of aerogel particles, fluoroplastic particles, fluorinated polyhedral oligomeric silsequioxane (POSS) particles, and fluorinated silica particles.

4. The transfer member of claim 1, wherein the texture particles comprise a size of from about 1 nm to about 2 microns.

5. The transfer member of claim 1, wherein the texture particles have a density lower than a density of the elastomeric matrix, wherein a density ratio of the texture particles to the elastomeric matrix is less than 0.8.

6. The transfer member of claim 1, wherein a density of the texture particles is from about 0.2 micrograms/cc to about 1 g/cc.

7. The transfer member of claim 1, wherein the texture particles have a surface tension of from about 8 mN/m to about 25 mN/m.

8. The transfer member of claim 1, wherein the texture particles have a surface energy lower than a surface energy of the elastomeric matrix in an amount of from 2 mN/m to about 15 mN/m.

9. The transfer member of claim 1, wherein the surface layer further comprises a plurality of filler particles selected from the group consisting of: inorganic oxides and carbon particles.

10. The transfer member of claim 9, wherein the optional fillers comprise from about 0.5 to about 10 weight percent of the transfer member.

11. A transfer member for use in aqueous ink jet printer, the transfer member comprising: a surface layer having a surface roughness (Ra) of from about 500 nm to about 1 microns, the surface layer including an elastomeric matrix having a plurality texture particles dispersed therein, the plurality of texture particles having a surface energy lower than a surface energy of the elastomeric matrix, wherein a weight percent of the texture particles in the surface layer is from about 0.2 weight percent to about 20 weight percent.

12. The transfer member of claim 11, wherein the texture particles comprise a size of from about 300 nm to about 800 nm.

13. The transfer member of claim 11, wherein the texture particles have a density lower than a density of the elastomeric matrix.

14. The transfer member of claim 11, wherein the elastomeric matrix is selected from the group consisting of silicones, fluorosilicones, fluoroplastics, fluoroelastomers, copolymers of two of vinylidenefluoride, hexafluoropropylene, terpolymers of vinylidenefluoride, hexafluoropropylene, and tetrafluoroethylene, and tetrapolymers of vinylidenefluoride, hexafluoropropylene, perfluoromethylvinylether (PMVE).

15. The transfer member of claim 11, wherein the plurality of texture particles is selected from the group consisting of aerogel particles, fluoroplastic particles, fluorinated polyhedral oligomeric silsequioxane (POSS) particles, and fluorinated silica particles.

16. The transfer member of claim 1, wherein the surface layer further comprises a plurality of filler particles selected from the group consisting of: inorganic oxides and carbon particles.

17. An ink jet printer comprising:

a transfer member comprising: a surface layer having a surface roughness of from about 500 nm to about 1 microns, the surface layer including an elastomeric matrix having a plurality texture particles dispersed therein, the plurality of texture particles having either a density lower than a density of the elastomeric matrix or a surface energy lower than a surface energy of the elastomeric matrix, wherein the plurality of texture particles in the surface layer is from about 3 weight percent to about 8 weight percent of the transfer member a print head adjacent said transfer member for ejecting aqueous ink droplets onto a surface of the transfer member to form an ink image;

a transfixing station located adjacent said transfer member and downstream from said print head, the transfixing station forming a transfixing nip with the transfer member at said transfixing station; and a transporting device for delivering a recording medium to the transfixing nip, wherein the ink image is transferred and fixed to the recording medium.

18. The ink jet printer of claim 17, wherein the texture particles have a density lower than a density of the elastomeric matrix, wherein a density ratio of the texture particles to the polymer matrix is less than 0.8.

19. The ink jet printer of claim 17, wherein the surface layer further comprises a plurality of filler particles selected from the group consisting of: inorganic oxides and carbon particles.

20. The ink jet printer of claim 17, wherein the plurality of texture particles is selected from the group consisting of aerogel particles, fluoroplastic particles, fluorinated polyhedral oligomeric silsequioxane (POSS) particles, and fluorinated silica particles.

* * * * *